US007312890B2

(12) United States Patent
Hatayama et al.

(10) Patent No.: US 7,312,890 B2
(45) Date of Patent: Dec. 25, 2007

(54) PRINTING APPARATUS

(75) Inventors: Fumihiro Hatayama, Kyoto (JP); Hiroya Yagi, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 1028 days.

(21) Appl. No.: 10/409,136

(22) Filed: Apr. 9, 2003

(65) Prior Publication Data

US 2003/0214675 A1 Nov. 20, 2003

(30) Foreign Application Priority Data

May 16, 2002 (JP) ..... P2002-141157

(51) Int. Cl.
*B41F 33/00* (2006.01)
*B41F 5/18* (2006.01)

(52) U.S. Cl. ..... 358/1.2; 358/1.4; 358/1.9; 358/1.18; 358/504; 358/406; 101/365; 101/181; 101/485; 101/211

(58) Field of Classification Search ..... 358/1.18, 358/504, 406, 1.2, 1.4, 1.9; 101/365, 181, 101/485, 211
See application file for complete search history.

(56) References Cited

U.S. PATENT DOCUMENTS 5,402,361 A * 3/1995 Peterson et al. ..... 382/167
5,826,139 A * 10/1998 Nacman et al. ..... 399/72
5,923,920 A * 7/1999 Ishida et al. ..... 399/46
6,009,807 A * 1/2000 Yoshida et al. ..... 101/177
6,119,594 A * 9/2000 Kipphan et al. ..... 101/365
6,446,555 B1 * 9/2002 Schramm et al. ..... 101/365
6,698,355 B2 * 3/2004 Fukui ..... 101/485
2001/0020427 A1 * 9/2001 Shiraishi ..... 101/365
2002/0043166 A1 4/2002 Okuda

FOREIGN PATENT DOCUMENTS

JP 2000-318125 11/2000
JP 2001-253054 9/2001

* cited by examiner

*Primary Examiner*—Douglas Q. Tran
*Assistant Examiner*—Chan S. Park
(74) *Attorney, Agent, or Firm*—McDermott Will & Emery LLP

(57) ABSTRACT

A method of applying a control strip having an appropriate size in accordance with the size of a print image is provided. Print image data is rasterized or RIP-processed in Step S1. Image layout data is acquired from the print image data in Step S2. The size of control strip image data is adjusted based on the image layout data in Step S3. The size of the control strip is determined to be a positive integral multiple of an ink key size, based on a previously established equation. Based on the size of the control strip image data, a previously prepared control strip having a maximum size is cut. The adjusted control strip image data and the print image data are combined together in Step S4. In Step S4, blank data are added to the left and right of the print image to extend the size of the print image to the size of the control strip.

20 Claims, 10 Drawing Sheets

PRINTING APPARATUS

BACKGROUND OF THE INVENTION

1. Field of the Invention

The present invention relates to a technique about a printing apparatus for outputting printed materials. More particularly, the invention relates to a technique for applying to a printing material a control strip for color management and the like of the printed materials to be outputted.

2. Description of the Background Art

In recent years, a printing apparatus equipped with a prepress (or plate-making) mechanism which contains a prepress means for recording an image on a printing plate for use in printing has been known in the art. A general offset printing apparatus, inclusive of such a printing apparatus equipped with the prepress mechanism, comprises an ink fountain mechanism having a plurality of ink keys so that a variable amount of ink supply is set for each of a plurality of ink key regions extending in the feed direction of a printing sheet. With such a printing apparatus, a control strip having patches for color management arranged in corresponding relation to the respective widths of the ink keys is printed in the margin of the printing sheet. It is common practice to adjust the amount of ink supply for each ink key, based on the printed density of the control strip.

A printed sheet with the control strip applied thereto is sampled for every appropriate number of printed sheets by an operator, and is subjected to a printed density measurement by means of a calorimeter and the like provided outside the printing apparatus. Recently, it has been possible to automatically measure the control strip in the printing apparatus by the use of an in-line printed matter measuring device disclosed in, for example, Japanese Patent Application Laid-Open No. 2001-253054. The provision of such an in-line measuring device produces a great effect in being able to automatically control the amount of ink supply and the like at all times without the need for an operator.

When a printing apparatus executes different print jobs in succession, images to be printed in the individual print jobs sometimes differ in dimension in a direction perpendicular to the print direction from each other. In such a case, the control strip is applied by the following methods.

A first method is to always apply a control strip having a maximum length. A second method is to cut the control strip in accordance with the dimension in the direction perpendicular to the print direction of an image to be printed before applying the control strip.

In the first method, control strip image data corresponding to the maximum length of the control strip is previously combined with print image data about an image to be printed. Prepress and printing are carried out based on the combined image data.

However, since the control strip having the maximum length is always applied, this method is disadvantageous in being unable to shorten the time required to execute RIP (Raster-Image-Processing) on the combined image data and the time to subsequently form an image on a printing plate even if the print image data itself is small in size.

The second method is to cut (or trim) the control strip image data corresponding to the maximum length in accordance with the dimension in the direction perpendicular to the print direction of the image to be printed and then to combine the resultant data with the print image data.

The second method does not cause the problem encountered in the first method, but is able to shorten the time for the RIP process and the time for the image formation if the print image data itself is small in size.

In the second method, however, the control strip is mechanically cut in accordance with the dimension in the direction perpendicular to the print direction of the image to be printed. Hence, there is a likelihood that patches indistinguishable in measurement of the printed density are present on opposite ends of the control strip. When the in-line printed matter measuring device for automatically measuring the control strip is provided in the printing apparatus as described above, the control of the amount of ink supply in an ink key corresponding to an end portion of the print image might become unstable due to the indistinguishable patches and ineffective measurement values calculated.

SUMMARY OF THE INVENTION

The present invention is intended for a technique for generating image data about a control strip to be formed on a printing material for color management and the like of printed materials in a printing apparatus.

According to the present invention, a printing apparatus for supplying ink to each of a plurality of ink keys arranged in a direction perpendicular to a feed direction of a printing material to perform printing on the printing material, based on an image recorded on a printing plate, comprises: a storing element for storing initial control strip data; an acquiring element for acquiring layout information serving as image layout data from print image data; an adjusting element for generating image data about a control strip from the initial control strip data stored in the storing element, the control strip being to be formed on the printing material, the control strip having a unit size equal to an ink key region size determined in corresponding relation to the plurality of ink keys, the size of the control strip being determined to be an integral multiple of the unit size, based on the initial control strip data and the image layout data; and a combining element for combining the print image data and the image data about the control strip together.

This allows the control strip of appropriate size to be applied to the printing material in accordance with the size of the print image. Additionally, the present invention prevents the control strip from being cut halfway, to present no problems in color management in the printing apparatus, thereby improving the stability of ink supply control.

It is therefore an object of the present invention to provide a printing apparatus capable of applying a control strip having an appropriate size in accordance with the size of a print image, and a method therefor.

These and other objects, features, aspects and advantages of the present invention will become more apparent from the following detailed description of the present invention when taken in conjunction with the accompanying drawings.

DESCRIPTION OF THE PREFERRED EMBODIMENTS

First Preferred Embodiment

Description of Printing Apparatus

Figure 1A:
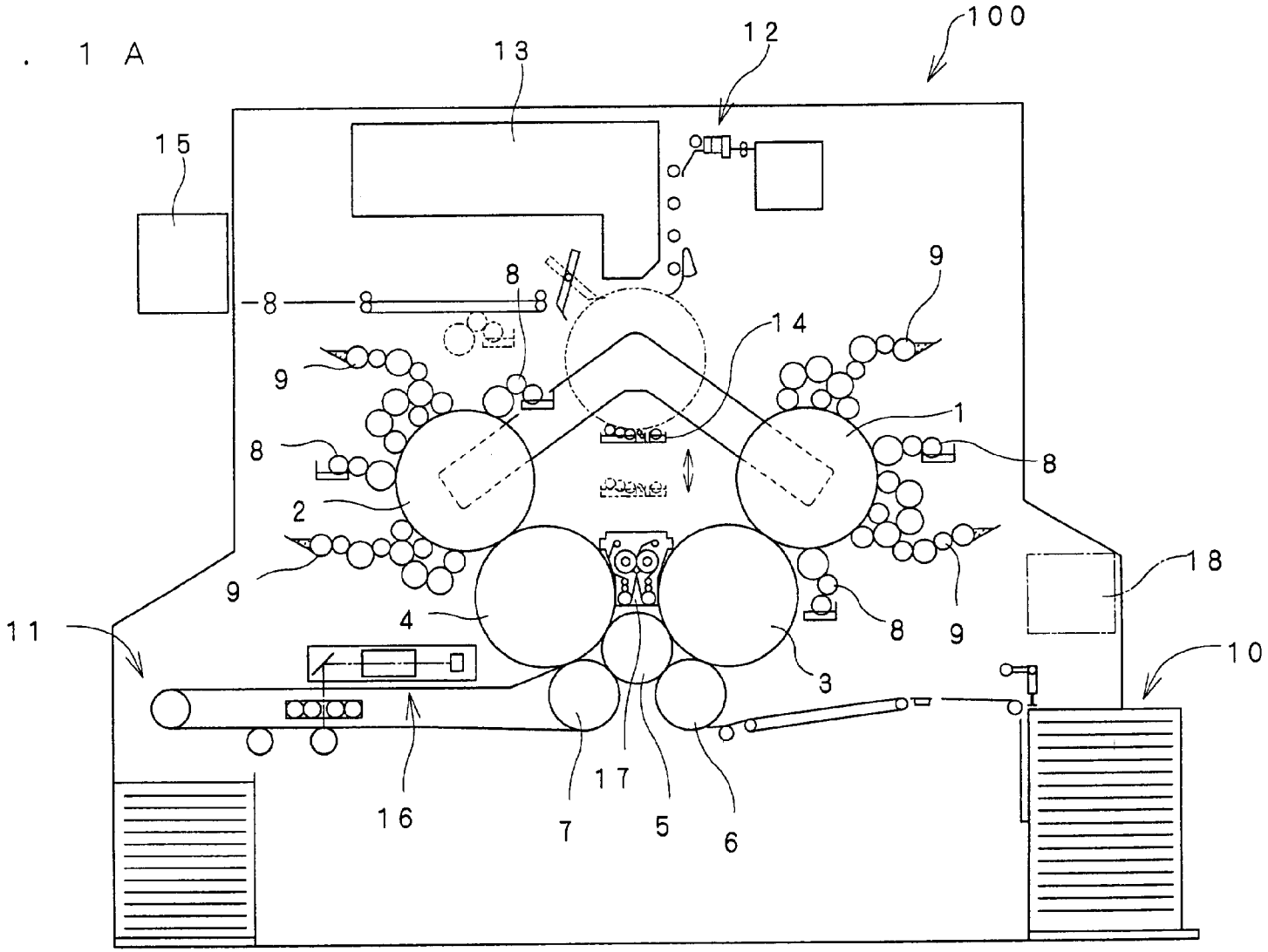
FIG. 1A is a schematic view of an example of a printing apparatus according to the present invention.

A printing apparatus 100 according to a preferred embodiment of the present invention will now be described with reference to the drawings. FIG. 1A is a schematic view of an example of the printing apparatus 100.

Referring first to FIG. 1A, the printing apparatus 100 comprises, as a printing mechanism: first and second plate cylinders (or ink transfer mechanisms) 1 and 2 for holding printing plates; first and second blanket cylinders 3 and 4 for transfer of an ink image from the respective plate cylinders 1 and 2 thereto; an impression cylinder 5 for holding a paper sheet (or a printing medium) p to be printed to which the ink image is transferred from the blanket cylinders 3 and 4; a paper feed cylinder 6 and a paper discharge cylinder 7 for feeding and discharging the sheet p to and from the impression cylinder 5; dampening water supply mechanisms 8 and ink supply mechanisms 9 for supplying dampening water and ink, respectively, to the printing plates on the first and second plate cylinders 1 and 2; a paper feed section 10 for sequentially feeding unprinted paper sheets p arranged in a stacked relation; and a paper discharge section 11 for sequentially receiving printed paper sheets p to form a stack.

As a prepress (or plate making) mechanism, the printing apparatus 100 comprises: a printing plate supply section 12 for supplying unexposed printing plates to the first and second plate cylinders 1 and 2; an image recording section 13 for recording an image on the printing plates held on the plate cylinders 1 and 2; a development section 14 for developing the printing plates with the image recorded thereon; and a printing plate discharge section 15 for discharging used printing plates.

The printing apparatus 100 further comprises an image reader 16 for capturing an image on the printed sheet p to measure an image density; a cleaning device 17 for cleaning the blanket cylinders 3 and 4; and a controller 18 for controlling the overall printing apparatus 100.

The parts of the printing apparatus 100 will be described in detail. The first plate cylinder 1 is movable by a plate cylinder drive mechanism not shown between a first printing position shown by a solid line in FIG. 1A and an image recording position shown by a dash-double dot line. Likewise, the second plate cylinder 2 is movable by a plate cylinder drive mechanism not shown between a second printing position shown by a solid line in FIG. 1A and the image recording position shown by the dash-double dot line. Specifically, the first and second plate cylinders 1 and 2 are in the first and second printing positions, respectively, when a printing process is performed, and are alternately located in the image recording position when a prepress (or plate making) process is performed on the printing plates held on the plate cylinders 1 and 2. Each of the first and second plate cylinders 1 and 2 has a peripheral surface capable of holding thereon two printing plates for two respective colors, and includes a pair of gripping mechanisms for fixing the printing plates, respectively, in circumferentially opposed positions 180 degrees apart from each other on the peripheral surface.

The first blanket cylinder 3 is adapted to rotate in contact with the first plate cylinder 1 in the first printing position. Likewise, the second blanket cylinder 4 is adapted to rotate in contact with the second plate cylinder 2 in the second printing position. The first and second blanket cylinders 3 and 4 are approximately equal in diameter to the first and second plate cylinders 1 and 2, and have a blanket mounted on their peripheral surface for transfer of ink images of two colors from each of the plate cylinders 1 and 2.

The impression cylinder 5 has a diameter approximately one-half the diameter of the first and second plate cylinders 1 and 2, and is adapted to rotate in contact with both of the first and second blanket cylinders 3 and 4. The impression cylinder 5 includes a gripping mechanism capable of holding the single sheet p having a size corresponding to that of the printing plate. The gripping mechanism is opened and closed in predetermined timed relation by an opening/closing mechanism not shown to grip a leading end of the sheet p.

The paper feed cylinder 6 and the paper discharge cylinder 7 are approximately equal in diameter to the impression cylinder 5, and each includes a gripping mechanism (not shown) similar to that of the impression cylinder 5. The gripping mechanism of the paper feed cylinder 6 is positioned to pass the sheet p in synchronism with the gripping mechanism of the impression cylinder 5, and the gripping mechanism of the paper discharge cylinder 7 is positioned to receive the sheet p in synchronism with the gripping mechanism of the impression cylinder 5.

The first and second plate cylinders 1 and 2 in the first and second printing positions, the first and second blanket cylinders 3 and 4, the impression cylinder 5, the paper feed cylinder 6 and the paper discharge cylinder 7 are driven by a printing driving motor not shown to rotate in synchronism with each other. In the printing apparatus 100, since the plate cylinders 1 and 2 and the blanket cylinders 3 and 4 have a circumference approximately twice greater than that of the impression cylinder 5, the impression cylinder 5 rotates two turns each time the plate cylinders 1 and 2 and the blanket cylinders 3 and 4 rotate one turn. Thus, two turns of the impression cylinder 5 with the sheet p held thereon effect multicolor printing using two colors from the first plate cylinder 1 and two colors from the second plate cylinder 2 or a total of four colors.

Two dampening water supply mechanisms 8 are provided for each of the plate cylinders 1 and 2 in the first and second printing positions, and are capable of selectively supplying the dampening water to the two printing plates on each of the plate cylinders 1 and 2. Each of the dampening water supply mechanisms 8 includes a water fountain for storing the dampening water, and a set of dampening water rollers for drawing up the dampening water from the water fountain to pass the dampening water to a printing plate surface. At least some of the set of dampening water rollers which contact the printing plate surface are brought into and out of contact with a plate cylinder surface by a cam mechanism. The dampening water supply mechanisms 8 need not be provided if the printing plates are of the type which requires no dampening water.

Figure 1B:
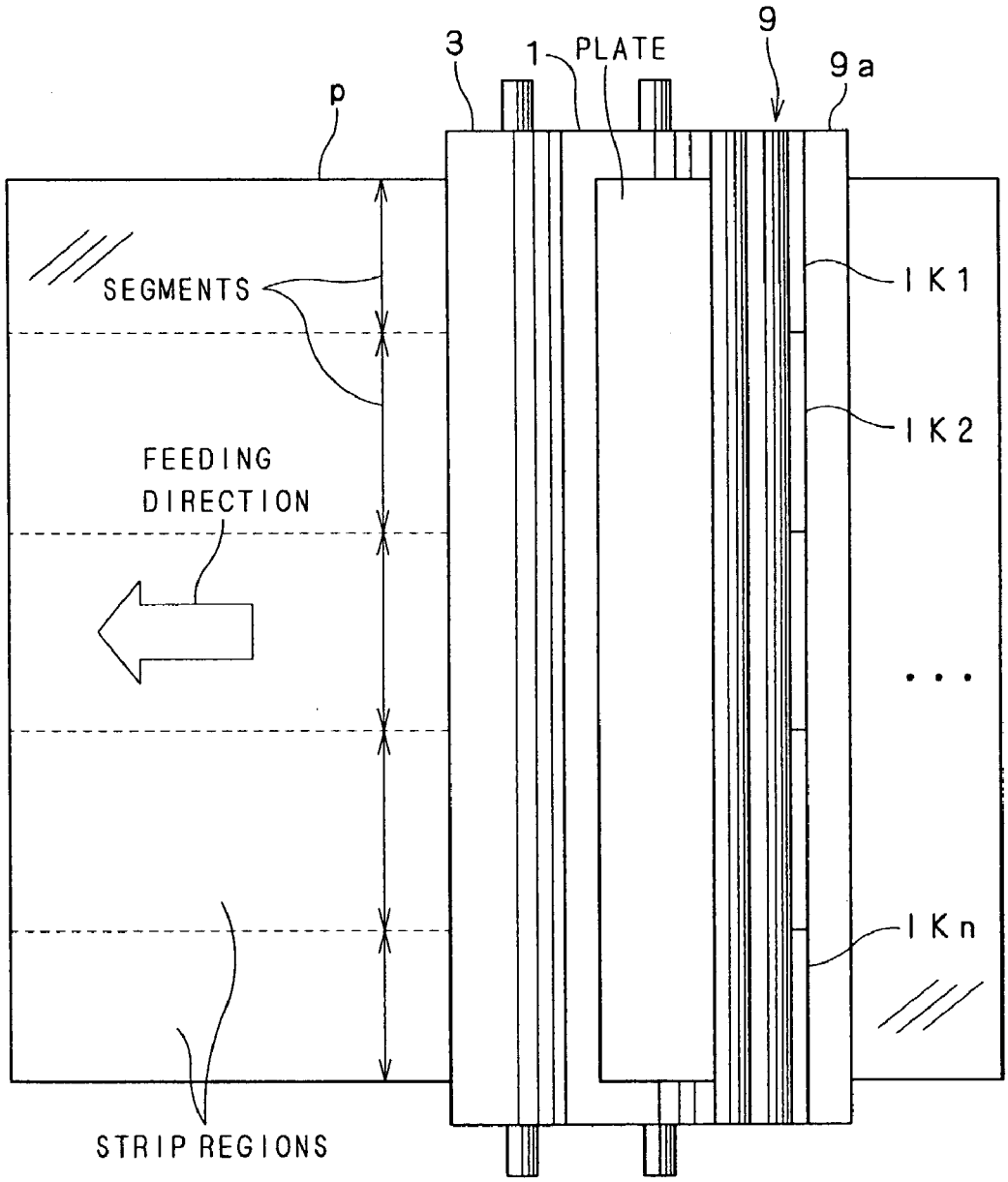
FIG. 1B is a schematic plan view illustrating transfer of ink from an ink supply mechanism to a print sheet.

Two ink supply mechanisms 9 are provided for each of the plate cylinders 1 and 2 in the first and second printing positions, and are capable of selectively supplying inks of different colors to the two printing plates on each of the plate cylinders 1 and 2. As illustrated in FIG. 1B, each of the ink supply mechanisms 9 includes an ink duct or ink fountain 9*a* capable of adjusting the amount of ink supply for each strip region extending in a predetermined feed direction (or forward direction) of the paper sheet p, and supplies the ink from the ink ducts through a plurality of ink rollers onto the printing plate surface on each of the plate cylinders 1 and 2. At least some of the ink rollers which contact the printing plate surface are brought into and out of contact with the plate cylinder surface by a cam mechanism. The ink duct 9*a* is provided with a plurality of ink keys IK1, IK2, . . . IKn. Respective amounts of ink supplied to a linear array of segments defined across the feed direction on the print paper p are independently adjusted by respective ink keys IK1, IK2, . . . IKn, whereby the ink density on respective strip regions on the print paper p are controlled. Only the part including the plate cylinder 1 and the blanket cylinder 3 is illustrated in FIG. 1B, and that including the plate cylinder 2 and the blanket cylinder 4 in FIG. 1A has a similar configuration.

The inks in the ink supply mechanisms 9 are, for example, such that the ink supply mechanisms 9 for K (black) and M (magenta) colors are provided for the first plate cylinder 1, and the ink supply mechanisms 9 for C (cyan) and Y (yellow) colors are provided for the second plate cylinder 2. At least some of the dampening water supply mechanisms 8 and ink supply mechanisms 9 which lie on the paths of movement of the first and second plate cylinders 1 and 2 are adapted to be shunted out of the paths of movement as the first and second plate cylinders 1 and 2 move.

The paper feed section 10 feeds paper sheets p, one at a time, from a stack of unprinted paper sheets p to the paper feed cylinder 6. In this preferred embodiment, the paper feed section 10 operates so that one paper sheet p is fed each time the paper feed cylinder 6 rotates two turns. The paper discharge section 11 receives printed paper sheets p from the paper discharge cylinder 7 to form a stack. The paper discharge section 11 includes a known chain transport mechanism for discharging and carrying a printed paper sheet p, with the leading end of the printed paper sheet p gripped by a gripper (or gripper finger) carried around by a chain. The image reader 16 is provided at some midpoint in the path of movement of the printed sheets p discharged by the paper discharge section 11.

Next, the prepress mechanism of the printing apparatus 100 will be described. In the printing apparatus 100, the first and second plate cylinders 1 and 2 are alternately moved to the image recording position during the execution of the prepress process. In this image recording position, a friction roller not shown is driven to rotate in contact with the plate cylinder 1 or 2.

The printing plate supply section 12 includes a cassette roll for storing a roll of unexposed printing plate while shielding the roll of unexposed printing plate from light, a transport roller and a transport guide for transporting the printing plate unwound from the cassette roll to the plate cylinder 1 or 2, and a cutting mechanism for cutting the printing plate into sheet form. In this preferred embodiment, a silver halide sensitive material is used for the printing plate, and laser light is used to record an image on the printing plate. The procedure of a printing plate supply operation includes: causing one of the gripping mechanisms not shown of the plate cylinder 1 or 2 to grip the leading end of the printing plate unwound from the cassette roll; rotating the plate cylinder 1 or 2 in this condition to wind the printing plate around the plate cylinder 1 or 2; then cutting the printing plate to length; and causing the other gripping mechanism to grip the trailing end of the printing plate.

The image recording section 13 turns on/off laser light to expose a printing plate to the light, thereby recording an image on the printing plate. In this preferred embodiment, the controller 18 determines the position of the image on the printing plate, and sends corresponding image data to the image recording section 13. The image recording section 13 effects main scanning with the laser light emitted from a laser source in the axial direction of the plate cylinder 1 or 2 by using a polarizer such as a polygon mirror, while effecting sub-scanning over the printing plate surface by rotating the plate cylinder 1 or 2.

The method of scanning may be of the type such that a plurality of laser sources are arranged in the axial direction of a plate cylinder and main scanning is carried out with a plurality of laser beams emitted from the respective laser sources as the plate cylinder rotates. The printing plate and the image recording section 13 are not limited to those of the type such that an image is recorded by exposure to light, but may be of the type such that an image is thermally or otherwise recorded.

The development section 14 develops the printing plate exposed by the image recording section 13. In this preferred embodiment, the development section 14 draws up a processing solution stored in a processing bath by using a coating roller to apply the processing solution to the printing plate, thereby developing the printing plate. The development section 14 includes an elevating mechanism for moving between a position in which the development section 14 is shunted from the plate cylinder 1 or 2 and a position in which the development section 14 is closer to the plate cylinder 1 or 2. The development section 14 itself need not be provided if an image recording method which requires no development is employed.

In the printing apparatus 100, the first and second plate cylinders 1 and 2 are moved to the image recording position, in which the prepress process is performed by supplying the printing plate and then recording and developing an image. After the prepress process is completed, the first and second plate cylinders 1 and 2 are moved to the first and second printing positions, respectively, for the printing process.

The printing apparatus 100 is capable of automatically discharging the printing plate after the printing process is completed. In this preferred embodiment, the printing plate discharge section 15 includes a peeling section for peeling the printing plate from the first or second plate cylinder 1 or 2 in the image recording position, a transport mechanism for transporting the peeled printing plate, and a discharge cassette for discharging the used printing plate so transported.

Figure 2:
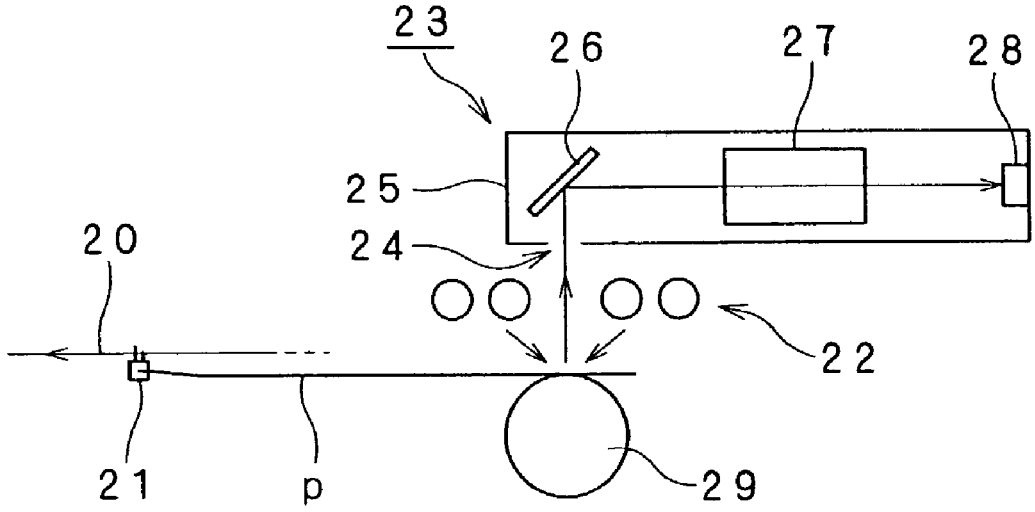
FIG. 2 is a schematic view of an image reader provided in the printing apparatus.

The details of the image reader 16 will be described with reference to the schematic view of FIG. 2. The image reader 16 reads an image on the printed paper sheet p gripped and transported by a gripper (or gripper finger) 21 carried around by a chain 20 of the paper discharge section 11. The image reader 16 includes an illuminating light source 22 for illuminating the printed paper sheet p, and a reader body 23 for receiving light reflected from the printed paper sheet p to convert the reflected light into an image signal.

The illuminating light source 22 includes a plurality of line light sources, e.g. fluorescent lamps, arranged in the feed direction of the printed paper sheet p. The reader body 23 includes a cover 25 formed with a permeable portion 24 for allowing the reflected light to pass therethrough, a reflecting mirror 26 provided in the cover 25, an optical system 27, and a photodetector 28.

The cover 25 blocks out disturbance light, dirt, ink mist and the like. The permeable portion 24 may be closed by using a light-permeable member or the like, or may be open. If the permeable portion 24 is open, it is preferable that a clean air from outside the printing apparatus 100 is introduced into the interior of the cover 25 to prevent dirt from entering the interior of the cover 25 through the permeable portion 24. The reflecting mirror 26 directs incident light from the printed paper sheet p toward the photodetector 28. The optical system 27 includes an optical member such as a lens for image-forming the incident light on the photodetector 28. The photodetector 28 includes a CCD line sensor for reading the printed image, line by line extending in a direction crosswise to the feed direction of the sheet p. This preferred embodiment employs a three-line CCD capable of reading three wavelengths for R, G and B.

The printed paper sheet p transported by the gripper 21 is vacuum-held and transported by a vacuum suction roller 29. This suppresses fluttering of the sheet p during image reading to stabilize the sheet p.

Figure 9:
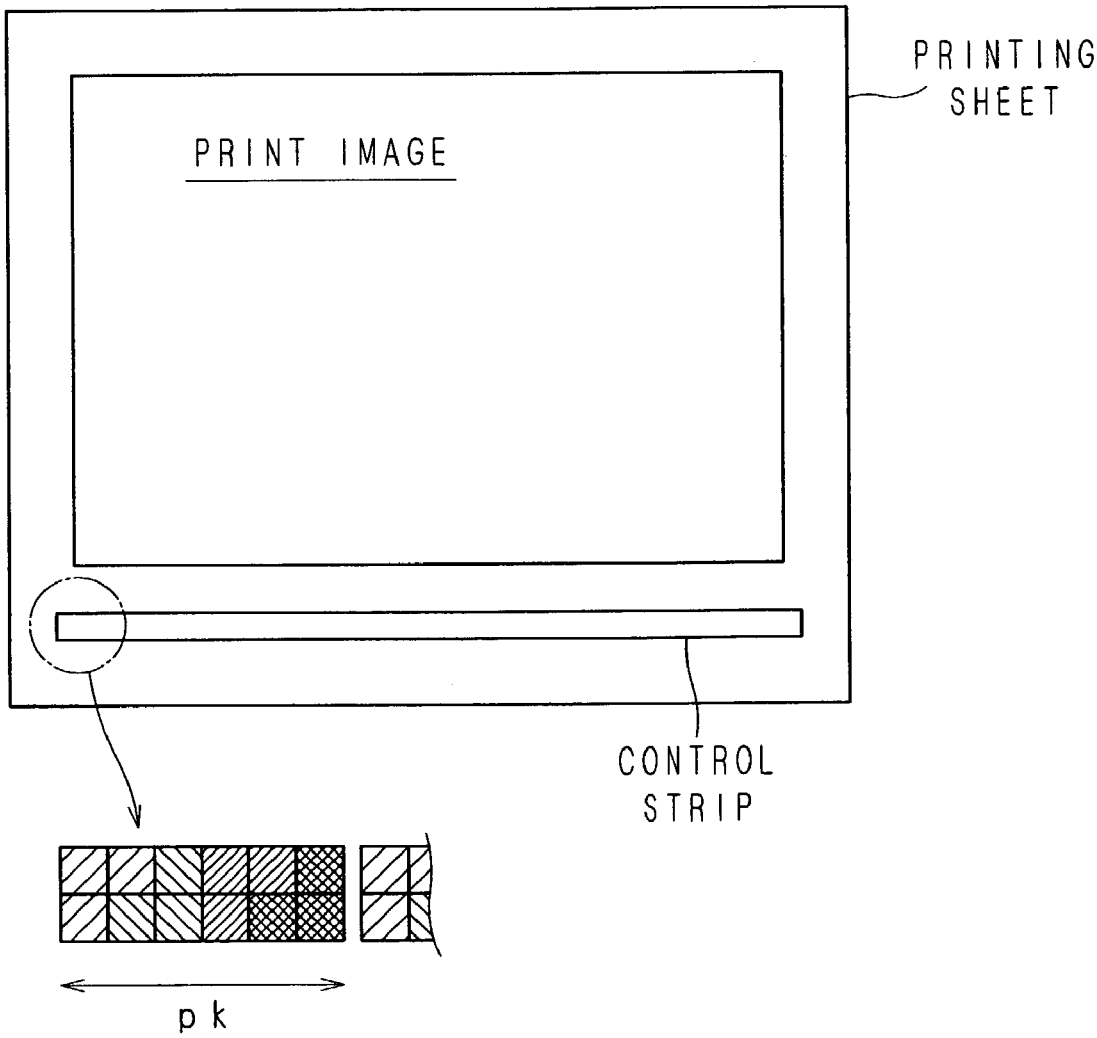
FIG. 9 shows an example of the control strip.

A predetermined control strip whose unit size is the size of a region (ink key region) corresponding to each ink key is previously formed on a printing sheet by the image recording section 13. As shown in FIG. 9, the control strip in this preferred embodiment includes 100% dense solid patches for respective CMYK colors and predetermined other-than-100% dense fine and coarse line patches in combination. A unit control strip pk corresponding to one ink key region is illustrated in FIG. 9.

The image reader 16 calculates the printed densities (YMCK densities, calorimetric values represented in the Lab color system, or the like) of the respective patches, based on image data obtained by imaging the patches of the control strip. Whether or not the amount of ink supply for each ink key region is proper is judged based on the calculated printed densities.

Of course, the control strip is not limited to the above-mentioned one, but may include halftone dot patches of other forms, and mixed color patches such as gray patches. Various marks (register marks and the like) may be added to the control strip. A method of applying control strip image data according to the present invention will be described later.

The cleaning device 17 comes in contact with the blanket cylinders 3 and 4 to clean the cylinder surfaces. In this preferred embodiment, individual cleaning devices are provided respectively for the blanket cylinders 3 and 4. The cleaning device 17 includes a cleaning solution supply mechanism, and a wiping mechanism using a cleaning cloth (or wiper).

The controller 18 is a microcomputer system including various input/output sections and storage sections, and is contained in the printing apparatus 100. The controller 18 controls the overall printing apparatus 100 based on a predetermined program operation. The controller 18 may be said to function as a controller for the printing apparatus from the viewpoint of the printing process, and to function as a controller for the prepress apparatus from the viewpoint of the prepress process. From a different viewpoint, the controller 18 may be said to function as an image data processor for applying control strip image data to the printing sheet p. The function as the image data processor may be implemented by a different computer system (e.g., an image processing terminal provided in the previous stage of the printing apparatus 100) than a controller for the printing apparatus 100.

Method of Applying Control Strip Image Data

Figure 3:
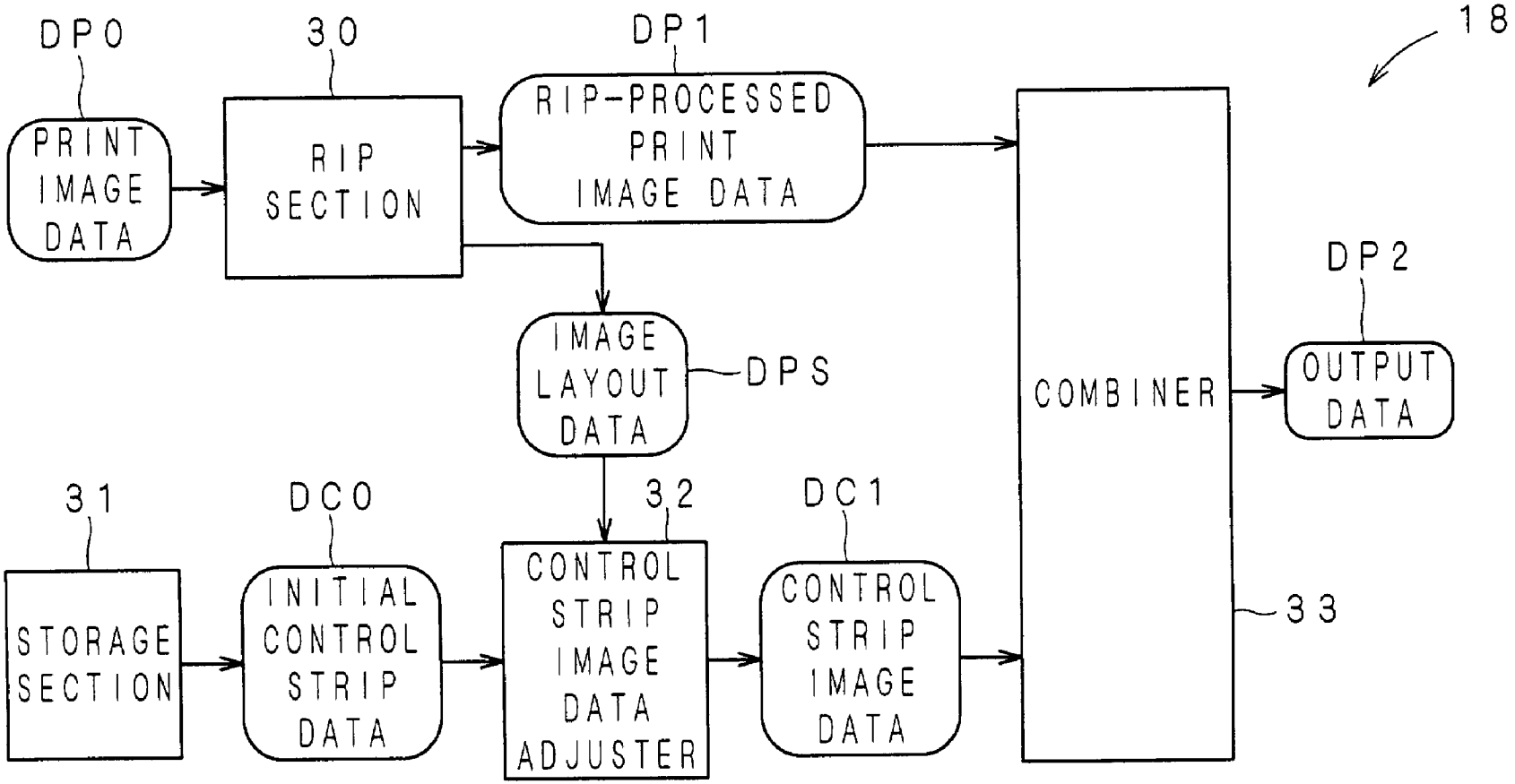
FIG. 3 is a block diagram showing a structure for an image data processing function according to a first preferred embodiment of the present invention.
Figure 4:
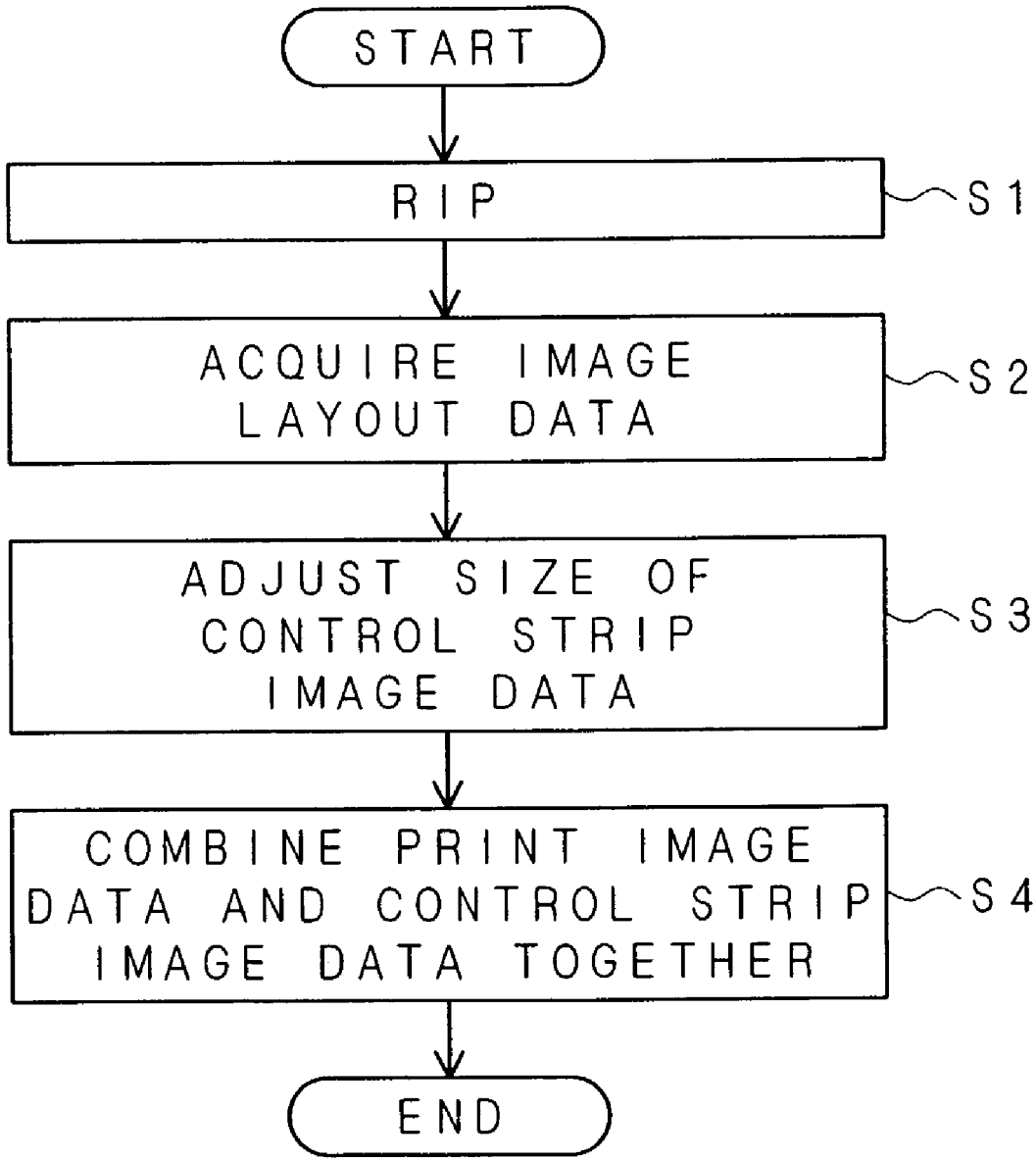
FIG. 4 is a flowchart showing a procedure for image data processing according to the first preferred embodiment.

Description will now be given on a method of applying the control strip image data according to the first preferred embodiment. FIG. 3 is a functional block diagram implemented in the controller 18 which carries out the method of applying the control strip image data according to the first preferred embodiment. FIG. 4 is a flowchart showing a procedure of the method.

The controller 18 principally comprises: a RIP section 30 for performing a RIP process on (or for rasterizing) print image data DP0 generated in a predetermined image processing terminal or the like; a storage section 31 for storing previously RIP-processed initial control strip data DC0 corresponding to a control strip having a maximum length; a control strip image data adjuster 32 for adjusting the size of the control strip in accordance with image layout data DPS in the print image data DP0 to generate control strip image data DC1; and a combiner 33 for combining the control strip image data DC1 and the RIP-processed print image data DP1 together to generate output data DP2.

Referring to FIG. 4, the controller 18 performs the RIP process on the print image data DP0 generated by an image layout device not shown or the like to generate the RIP-processed print image data DPI having a binary image data format, in Step S1.

Next, the image layout data DPS is acquired from the print image data DP0 in Step S2. The image layout data DPS includes data determined depending on the individual print image data DP0 such as the size of a print image and the layout of the print image on the printing sheet, and data about the layout of the printing sheet and the ink keys which are inherent in the printing apparatus. The former may be calculated from the print image data DP0 or may employ a value previously entered by an operator.

Figure 5:
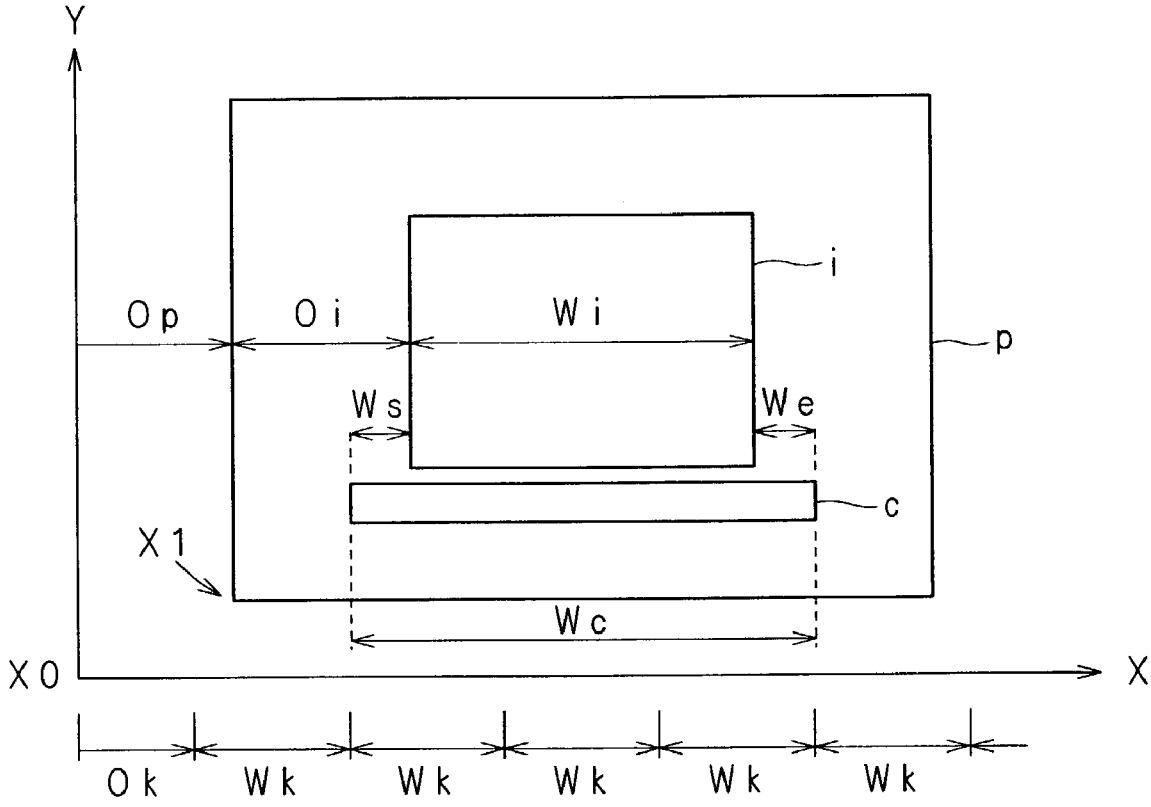
FIG. 5 is a view for illustrating the calculation of the size of a control strip.

In step S3, the size of the control strip is adjusted. Specifically, the control strip image data DC1 corresponding to a control strip the size of which is appropriately adjusted is obtained from the initial control strip data DC0 corresponding to the control strip having the maximum length stored in the storage section 31, based on the image layout data DPS. A calculation method for adjusting the control strip to the appropriate size will be described with reference to FIG. 5. FIG. 5 schematically illustrates the sizes of the print image and the control strip, with the ink keys enlarged for the sake of clarity.

In FIG. 5, the print direction of a print image i is defined as the Y direction, and a direction perpendicular to the print direction is defined as the X direction. Wi denotes the size of the print image in the X direction; Op denotes the offset in the X direction from a predetermined origin X0 to the position of a printing sheet p when placed; Oi denotes the offset in the X direction from an end X1 of the printing sheet p to the position of the print image i when placed; Wk denotes the size in the X direction of each of the ink keys Ik1 to Ikn (collectively designated as Ik hereinafter) of the printing apparatus 100; and Ok denotes the offset in the X direction of the ink keys Ik from the origin X0. These values are previously determined as the image layout data DPS.

A control strip c has a size Wc adjusted to n times the size Wk of each ink key Ik (where n is a positive integer equal to or greater than one). Additionally, the length Wc of the control strip c is adjusted to satisfy:

$$Wc = n \times Wk \quad (1)$$

$$= Ws + Wi + We$$

where Ws and We are extension sizes for which the control strip c is extended in the negative and positive X directions, respectively, from the print image i.

The extension sizes Ws and We are calculated by $$Ws = MOD\{(Op+Oi-Ok)/Wk\} \quad (2)$$

$$We = Wk - MOD\{(Op+Oi+Wi-Ok)/Wk\} \text{ (when MOD}\{(Op+Oi+Wi-Ok/Wk\} \neq 0) \quad (3)$$

$$We = 0 \text{(when MOD}\{(Op+Oi+Wi-Ok)/Wk\} = 0) \quad (4)$$

where MOD{x} is a function for outputting a remainder of the division x.

The above-mentioned equations calculate the size Wc of the control strip c. Thus, cutting the previously prepared initial control strip data DC0 in accordance with the size Wc provides the control strip image data DC1 having a minimum required size and adjusted to n times the size Wk of each ink key.

Figure 6:
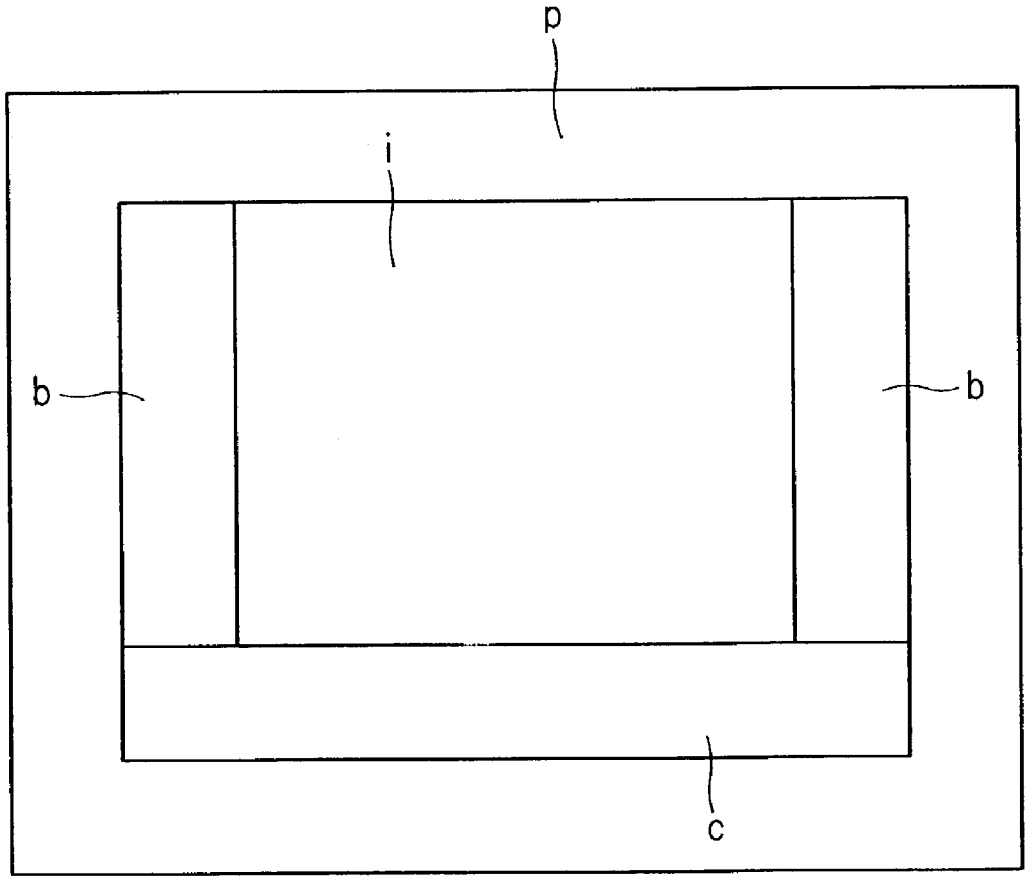
FIG. 6 is a view for illustrating the addition of blank data.

Referring again to FIG. 4, the adjusted control strip image data DC1 and the print image data DP1 are combined together into the output data DP2, in Step S4. In Step 4, the area of the print image is extended to the size of the control strip c, and blank images b (or blank data) dependent on the size of the control strip c are added to the left and right of the print image i, as shown in FIG. 6.

The output data DP2 generated by combination in accordance with the procedure shown in the flowchart is then sent to the image recording section 13 for use in the prepress operation to be performed on the printing plate.

The aforementioned method of applying the control strip image data produces the effect of being able to apply the control strip image data DC1 having an appropriate size in accordance with the size of the print image data DP0. In particular, when the present invention is applied to the printing apparatus 100 having the prepress function, the preparation of only the print image data DP0 allows the automatic formation of the image with the appropriate control strip added thereto on the printing plate. This facilitates the operation of preparing data to improve the efficiency of the entire operation. Additionally, when main scanning is performed in the axial direction of the plate cylinder during the recording of the printing plate, the scan range of the laser light in the main scanning direction may be reduced in accordance with the size of the control strip. This shortens the time required for the recording.

This method also prevents the control strip from being cut halfway which results in measurement of ineffective measurement values at an end of the image.

Further, when the printing apparatus 100 is provided with an in-line printed density measuring device, the first preferred embodiment automatically provides a control strip suitable for the printed density measuring device to facilitate the automation of ink supply control and the like.

In the first preferred embodiment, the previously RIP-processed initial control strip data DC0 is stored for combination with the RIP-processed print image data. This is advantageous in shortening the time required for image processing such as the RIP process.

Second Preferred Embodiment

Figure 7:
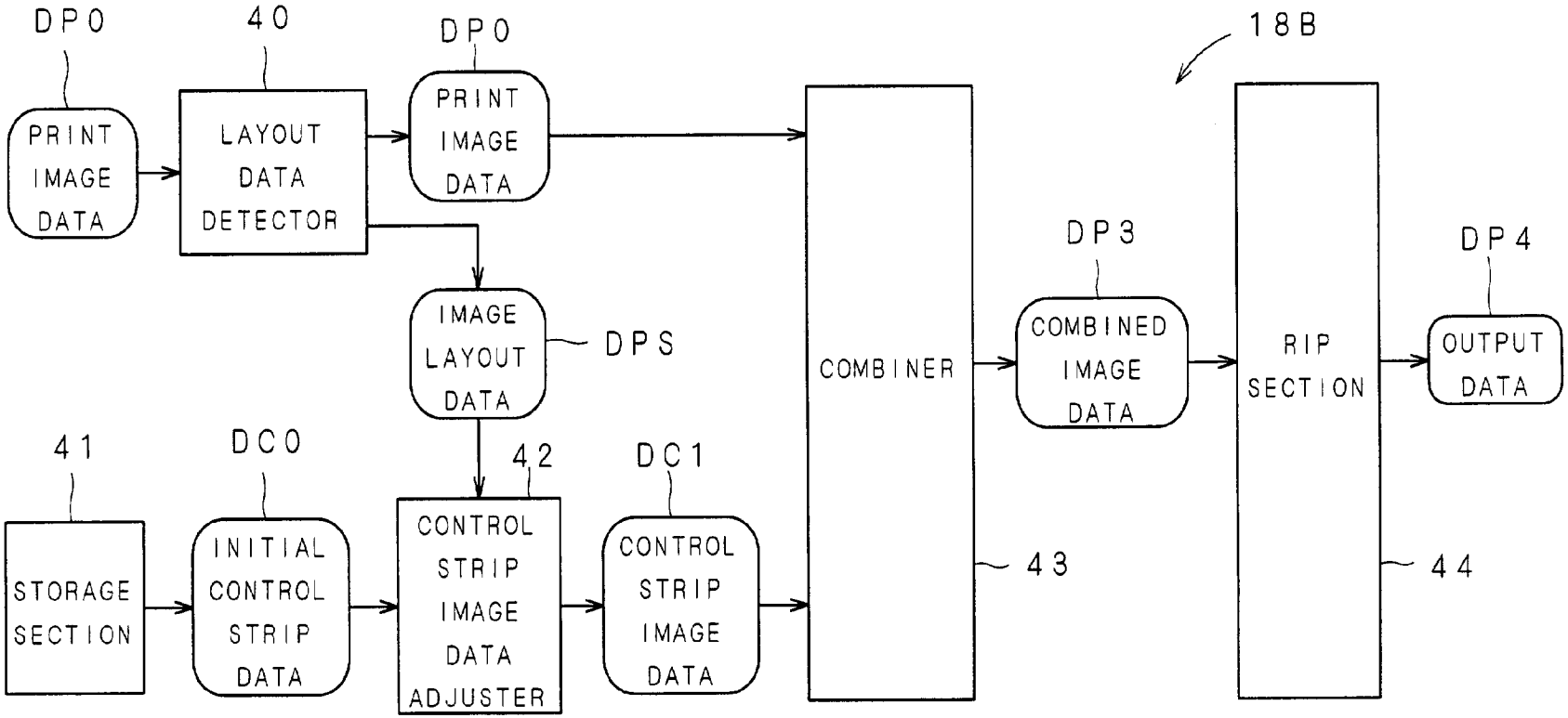
FIG. 7 is a block diagram showing a structure for the image data processing function according to a second preferred embodiment of the present invention.

A second preferred embodiment according to the present invention relates to a method which performs the RIP process after the control strip image data is combined with the print image data. The second preferred embodiment will be described with reference to FIGS. 7 and 8. FIG. 7 is a functional block diagram of a controller 18B according to the second preferred embodiment, and FIG. 8 is a flowchart showing a procedure according to the second preferred embodiment.

According to the second preferred embodiment, the controller 18B principally comprises: a layout data detector 40 for detecting the image layout data DPS about a print image from the print image data DP0; a storage section 41 for storing the initial control strip data DC0 corresponding to the control strip having the maximum length; a control strip image data adjuster 42 for adjusting the size of the control strip in accordance with the image layout data DPS in the print image data DP0 to provide the control strip image data DC1; a combiner 43 for combining the control strip image data DC1 and the print image data DP0 together to generate combined image data DP3; and a RIP section 44 for performing the RIP process on the combined image data DP3 to generate output data DP4.

Figure 8:
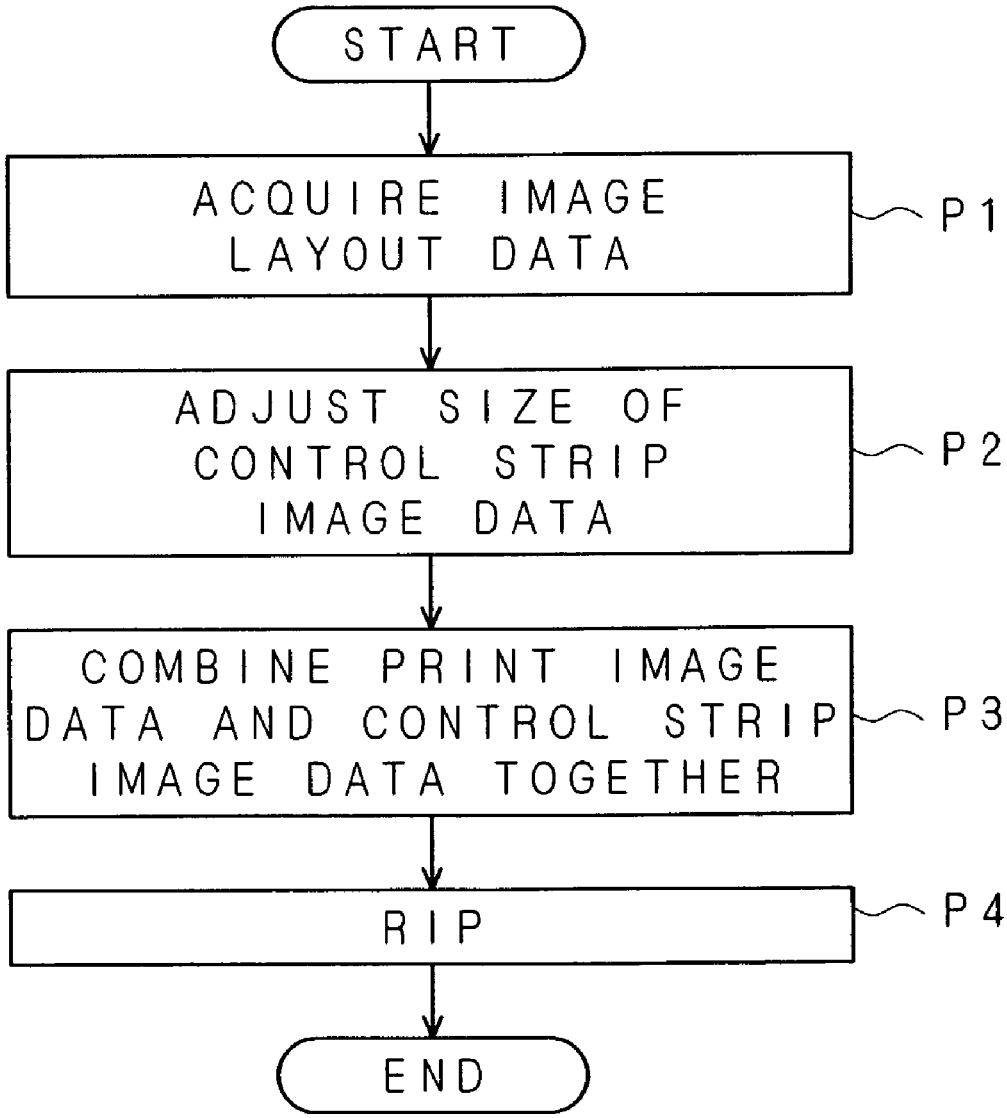
FIG. 8 is a flowchart showing a procedure for image data processing according to the second preferred embodiment.

In the controller 18B, the image layout data DPS is initially acquired from the print image data DP0 in Step P1, as shown in FIG. 8. The image layout data DPS may be calculated from the print image data DP0 or may employ a value previously entered by an operator.

In Step P2, the size of the control strip is adjusted. This step is carried out, for example, in the same manner as the calculation method in Step S3 in the first preferred embodiment.

In Step P3, the adjusted control strip image data DC1 and the print image data DP0 are combined together into the combined image data DP3. In this step, the blank images are added to the left and right of the print image in accordance with the size of the control strip in a manner similar to the first preferred embodiment. In Step P4, the RIP process is performed on the entire combined image data DP3 to generate the output data DP4.

The aforementioned method of applying the control strip image data according to the second preferred embodiment also produces the effect of being able to apply the control strip image data having the appropriate size in accordance with the print image data DP0.

Additionally, the second preferred embodiment can apply the control strip before the RIP process, thereby to easily apply control strips of various forms.

Third Preferred Embodiment

In the first and second preferred embodiments, the control strip image data having the maximum size is previously prepared, and is then adjusted to a required size, as necessary. Instead, a control strip having an appropriate size may be formed by joining together a required number n of unit control strips each having a length equal to the size Wk of each ink key Ik.

This technique derives the number n of keys from the size Wc of the control strip c calculated in the first preferred embodiment. Therefore, the same number n of unit control strips as the ink keys may be joined together to form a control strip.

Other Preferred Embodiments (1) When to apply the control strip image data to the print image data is limited to neither before the RIP process nor after the RIP process. For example, the control strip image data may be applied to intermediate data being RIP-processed.

(2) The print image data and the control strip image data may be sent in succession to the image recording section 13 for continuous image recording, rather than being directly combined together. This also produces effects similar to those produced when the image data is substantially applied.

(3) The operation of applying the control strip image data to the print image data may be performed in an image data processor or in a prepress apparatus in the previous stage of the printing apparatus 100.

While the invention has been described in detail, the foregoing description is in all aspects illustrative and not restrictive. It is understood that numerous other modifications and variations can be devised without departing from the scope of the invention.

What is claimed is:

1. A printing apparatus for supplying ink to each of a plurality of ink keys arranged in a first direction perpendicular to a second direction which is a feed direction of a printing material to perform printing on said printing material, based on an image recorded on a printing plate, said printing apparatus comprising:

a storing element for storing initial control strip data;

an acquiring element for acquiring layout information serving as image layout data from print image data;

generating element for generating image data about a control strip from said initial control strip data stored in said storing element, said control strip being to be formed on said printing material, said control strip having a unit size equal to an ink key region size corresponding to a size that each of said plurality of ink keys has equally in said first direction, the size of said control strip in said first direction being determined to be an integral multiple of said unit size, based on said initial control strip data and said image layout data; and a combining element for combining said print image data and said image data about said control strip together.

2. The printing apparatus according to claim 1, wherein the size of said control strip in said first direction is determined to be a minimum size exceeding the size in said first direction of the whole of print image formed by said print image data.

3. The printing apparatus according to claim 2, wherein said initial control strip data is original image data about an original control strip having a maximum size in said first direction, and said image data about said control strip is generated by extracting part of said initial control strip data, based on said size of said control strip in said first direction.

4. The printing apparatus according to claim 3, wherein:

said acquiring element comprises a rasterizing element for rasterizing said print image data;

said initial control strip data is previously rasterized and then stored; and said print image data is rasterized by said rasterizing element and said rasterized print image data is provided to said combining element.

5. The printing apparatus according to claim 3, further comprising a rasterizing element for rasterizing combined image data generated by said combining element.

6. A prepress apparatus for recording an image on a printing plate, comprising:

a storing clement for storing initial control strip data;

an acquiring element for acquiring layout information serving as image layout data from print image data;

generating element for generating image data about a control strip from said initial control strip data stored in said storing element, said control strip being to be formed on a printing material, said control strip having a unit size equal to an ink key region size corresponding to a size in first direction of an ink key of a printing apparatus for performing printing using said printing plate, said first direction pernendicular to second direction which is a feed direction of a printing material to perform printing on said printing material in said printing apparatus, the size of said control strip in said first direction being determined to be an integral multiple of said unit size, based on said initial control strip data and said image layout data; and a combining element for combining said print image data and said image data about said control strip together.

7. The prepress apparatus according to claim 6, wherein the size of said control strip in said first direction is determined to be a minimum size exceeding the size in said first direction of the whole of print image formed by said print image data.

8. The prepress apparatus according to claim 7, wherein said initial control strip data is original image data about an original control strip having a maximum size in said first direction, and said image data about said control strip is generated by extracting part of said initial control strip data, based on said size of said control strip in said first direction.

9. The prepress apparatus according to claim 8, wherein:

said acquiring element comprises a rasterizing element for rasterizing said print image data;

said initial control strip data is previously rasterized and then stored; and said print image data is rasterized by said rasterizing element and said rasterized print image data is provided to said combining element.

10. The prepress apparatus according to claim 8, further comprising a rasterizing element for rasterizing combined image data generated by said combining element.

11. An image data processor for generating prepress image data, comprising:

a storing element for storing initial control strip data;

an acquiring element for acquiring layout information serving as image layout data from print image data;

generating element for generating image data about a control strip from said initial control strip data stored in said storing element, said control strip being to be formed on a printing material, said control strip having a unit size equal to an ink key region size corresponding to a size in first direction of an ink key of a printing apparatus for performing printing based on said prepress image data, said first direction perpendicular to second direction which is a feed direction of a printing material to perform printing on said printing material in said printing apparatus, the size of said control strip in said first direction being determined to be an integral multiple of said unit size, based on said initial control strip data and said image layout data; and a combining element for combining said print image data and said image data about said control strip together.

12. The image data processor according to claim 11, wherein the size of said control strip in said first direction is determined to be a minimum size exceeding the size in said first direction of the whole of print image formed by said print image data.

13. The image data processor according to claim 12, wherein said initial control strip data is original image data about an original control strip having a maximum size in said first direction, and said image data about said control strip is generated by extracting part of said initial control strip data, based on said size of said control strip in said first direction.

14. The image data processor according to claim 13, wherein:

said acquiring element comprises a rasterizing element for rasterizing said print image data; said initial control strip data is previously rasterized and then stored; and said print image data is rasterized by said rasterizing element and said rasterized print image data is provided to said combining element.

15. The image data processor according to claim 13, further comprising a rasterizing element for rasterizing combined image data generated by said combining element.

16. A method of forming a control strip on a printing material, comprising the steps of:

(a) storing initial control strip data;

(b) acquiring layout information serving as image layout data from print image data;

(c) generating image data about a control strip from said initial control strip data stored in said step (a), said control strip being to be formed on said printing material, said control strip having a unit size equal to an ink key region size corresponding to a size in first direction of an ink key of a printing apparatus for performing printing on said printing material, said first direction perpendicular to second direction which is a feed direction of a printing material to perform printing on said printing material in said printing apparatus, the size of said control strip in said first direction being determined to be an integral multiple of said unit size, based on said initial control strip data and said image layout data; and (d) combining said print image data and said image data about said control strip together.

17. The method according to claim 16, wherein said initial control strip data is original image data about an original control strip having a maximum size in said first direction, and said image data about said control strip is generated by extracting part of said initial control strip data, based on said size of said control strip in said first direction.

18. The method according to claim 17, wherein blank data corresponding to a blank region appropriate to the size of said control strip in said first direction is combined with said print image data and said image data about said control strip in said step (d).

19. The method according to claim 18, wherein:

said step (b) comprises the step of (b-1) rasterizing said print image data;

said initial control strip data is previously rasterized and then stored; and said print image data is rasterized in said step (b-1) and said rasterized print image data is subjected to the combination in said step (d).

20. The method according to claim 18, further comprising the step of (e) rasterizing combined image data generated in said step (d).

* * * * *